US007404458B2

(12) United States Patent
Leon et al.

(10) Patent No.: US 7,404,458 B2
(45) Date of Patent: Jul. 29, 2008

(54) ROTARY PERCUSSIVE DRILLING DEVICE

(75) Inventors: Franck Leon, Lyons (FR); Frederic Brongniart, Liergues (FR)

(73) Assignee: Sandvik Mining and Construction Lyon SAS, Meyzieu (FR)

( * ) Notice: Subject to any disclaimer, the term of this patent is extended or adjusted under 35 U.S.C. 154(b) by 150 days.

(21) Appl. No.: 11/397,646

(22) Filed: Apr. 5, 2006

(65) Prior Publication Data

US 2006/0207800 A1 Sep. 21, 2006

(51) Int. Cl.
*E21B 4/14* (2006.01)

(52) U.S. Cl. ..... 175/296; 175/93; 175/299

(58) Field of Classification Search ..... 175/93, 175/100, 296, 299; 173/91, 197, 59, 75, 173/78, 80; 299/16, 17, 69
See application file for complete search history.

(56) References Cited

U.S. PATENT DOCUMENTS 4,141,592 A * 2/1979 Lavon ..... 299/16
5,803,188 A * 9/1998 McInnes ..... 175/92
6,910,542 B1 * 6/2005 Walter ..... 175/56

FOREIGN PATENT DOCUMENTS

EP 0 733 152 B1 3/2003

* cited by examiner

*Primary Examiner*—David J. Bagnell
*Assistant Examiner*—David Andrews
(74) *Attorney, Agent, or Firm*—Oliff & Berridge, PLC

(57) ABSTRACT

The device has a drill body, of generally cylindrical shape, connected by a flexible pipe to a high-pressure water pump placed on a low-height carrying vehicle. A striking piston is mounted movably, and is resiliently returned, in the drill body, and is subjected to a pulsed high water pressure so as to be moved with a percussive movement against a bit-carrying anvil, the pipe simultaneously transmitting to the drill body an alternating rotary movement about its principal axis. A solenoid valve, interposed between the pump and the point of departure of the pipe, receives successive electrical pulses causing opening and closing, which create shock waves in the water column contained in the pipe, which transmits these shock waves to the striking piston of the drill body. Applications: underground workings, mine workings, particularly for use in low-height galleries.

7 Claims, 2 Drawing Sheets

ROTARY PERCUSSIVE DRILLING DEVICE

BACKGROUND OF THE INVENTION

The present invention relates to the field of drilling in underground workings, and particularly in mine workings. It relates in particular to a rotary percussive drilling device, adapted for use in low-height mine galleries, particularly for drilling holes in the roofs of these galleries. The invention also proposes a method of rotary percussive drilling applied by this device.

DESCRIPTION OF THE PRIOR ART

A conventional drilling device, called an "out of hole" device, which can be used for this purpose has a drill provided with a drill bar, the drill being moved vertically along a slide and exerting a rotary percussive force. However, this device is not well adapted for use in low-height mine galleries, since the maximum depth of the hole is limited by the height of the gallery and the length of the drill. For example, in a mine gallery with a height of 1.10 meters, and with a drill 300 mm in length, the maximum hole depth is approximately 700 mm, taking into account the clearances required to manipulate the tools, which in this case are approximately 100 mm for maneuvering the drill bar.

To excavate longer holes, one known solution consists of mounting a train of drill rods on the drill, but this solution is heavy and constraining because it requires the successive joining of extension rods to each other, and the disconnection and reconnection of the drill from and to the train of rods as the hole becomes deeper in the course of drilling.

Another known device, called an "in-hole hammer" device, described for example in patent EP 0,733,152 B1, is better adapted for use in low-height mine galleries. It has a drill body, of generally cylindrical shape, connected by a pipe to a remotely located high-pressure water pump, a striking piston being mounted to be movable by translation in the drill body, and being subjected to a pulsed high water pressure so as to be moved with a striking movement against a bit-carrying anvil, the pipe simultaneously transmitting to the drill body a rotary movement about its principal axis, enabling the impact point of the bit tips to be varied during drilling.

In this patent EP 0,733,152 B1, the alternating distribution of water under high pressure, which creates the percussive action of the striking piston, is however provided by means entirely incorporated in the drill body, and therefore the length and diameter of the drill body are large. In particular, the diameter of the drill body makes it practically impossible to drill holes with a diameter of less than 45 mm, although it is sometimes desirable to be able to drill holes with a small diameter, of the order of 25 to 35 mm, for example in order to install supporting bolts in the roof of a mine gallery.

SUMMARY OF THE INVENTION

The object of the present invention is to overcome these drawbacks by providing a drilling device enabling deep and small-diameter holes to be drilled, while being adapted for use in low-height mine galleries.

For this purpose, the invention proposes a drilling device of the kind described in the aforementioned patent EP 0,733,152 B1, in which the drill body is connected by a flexible pipe to a water pump placed on a low-height carrying vehicle and in which a solenoid valve is interposed, on the carrying vehicle, between the water pump and the point of departure of the flexible pipe, the solenoid valve receiving successive electrical pulses in operation to cause opening and closing, which create shock waves in the water column contained in the flexible pipe, which transmits these shock waves to the striking piston, which is resiliently returned, of the drill body.

Thus, the basic principle of the invention is to place in a remote position outside the hole to be drilled, on a low-height carrying vehicle, means for the pulsed distribution of water under high pressure, acting on the striking piston, thus enabling the length and diameter of the drill body to be reduced and enabling deep and small-diameter holes to be drilled, without any limits imposed by the height of the mine gallery.

In one possible arrangement, a hydraulic accumulator is associated, on the carrying vehicle, with the water pump, in order to limit the pressure peaks generated by the pump.

Advantageously, means for advancing and guiding the flexible pipe are provided on the carrying vehicle in order to transmit a thrust movement to the drill body, the depth of the drilled hole being substantially equivalent to the travel of the flexible pipe.

The means for advancing the flexible pipe comprise, for example, a platform mounted to be movable by horizontal translation on a chassis of the carrying vehicle, in the longitudinal direction of this chassis, the water pump, the solenoid valve and an electrical pulse generator coupled to the solenoid valve being mounted on this platform, the platform being movable by translation in the longitudinal direction of the chassis by motorized operating means. In this case, the maximum depth of the drilled hole is advantageously limited only by the length of the flexible pipe, and by the forward travel of the platform.

In another possible arrangement, the means for advancing the flexible pipe comprise an unwinder, mounted on the carrying vehicle, on which the flexible pipe is wound, a rotary joint connecting the point of departure of this flexible pipe to the water pump. This variant makes it unnecessary to have any large moving part on the carrying vehicle.

The means for guiding the flexible pipe in translation can include a slide or a channel for diverting and guiding in the vertical direction, in the form of an elbow for example, positioned at the front of the carrying vehicle.

According to another aspect of the invention, means for rotating the flexible pipe are provided on the carrying vehicle to transmit to the drill body an alternating rotary movement about its principal axis. This arrangement enables the bit-carrying anvil to be given the necessary rotary movement to break the rock, without the need to rotate the bulky assembly of elements mounted on the carrying vehicle.

The device can also comprise means for supporting and guiding the drill body when starting a hole to be drilled, to ensure the correct positioning and vertical guiding of the drill body.

The drill body can have openings, for example grooves, through which the water and debris of rocks broken during drilling are removed, water being used advantageously in this case to remove the rock debris detached by drilling.

The choice of water as the driving fluid also enables the diameter of the drill body to be kept to a minimum, since it does not contain any water recovery duct, water being an environmentally clean fluid which can be discharged into a mine gallery without any hazard.

The invention also proposes a rotary percussive drilling method, adapted for use in low-height mine galleries, using a drill connected by a pipe to a high-pressure water pump, a striking piston being mounted to be movable by translation in the drill body, and subjected to a pulsed high water pressure, this method being applied by the device defined above and thus wherein shock waves are generated in the water remotely from the drill, more particularly outside the hole being drilled, and are transmitted to the striking piston of the drill body by the water column contained in the pipe, the water released at the drill body being used to remove the rock debris detached during the drilling.

BRIEF DESCRIPTION OF THE DRAWINGS

The invention will be more clearly understood with the aid of the following description, which refers to the attached schematic drawing representing, by way of example, an embodiment of this drilling device, and illustrating this drilling method.

DESCRIPTION OF THE PREFERRED EMBODIMENT

Figure 1:
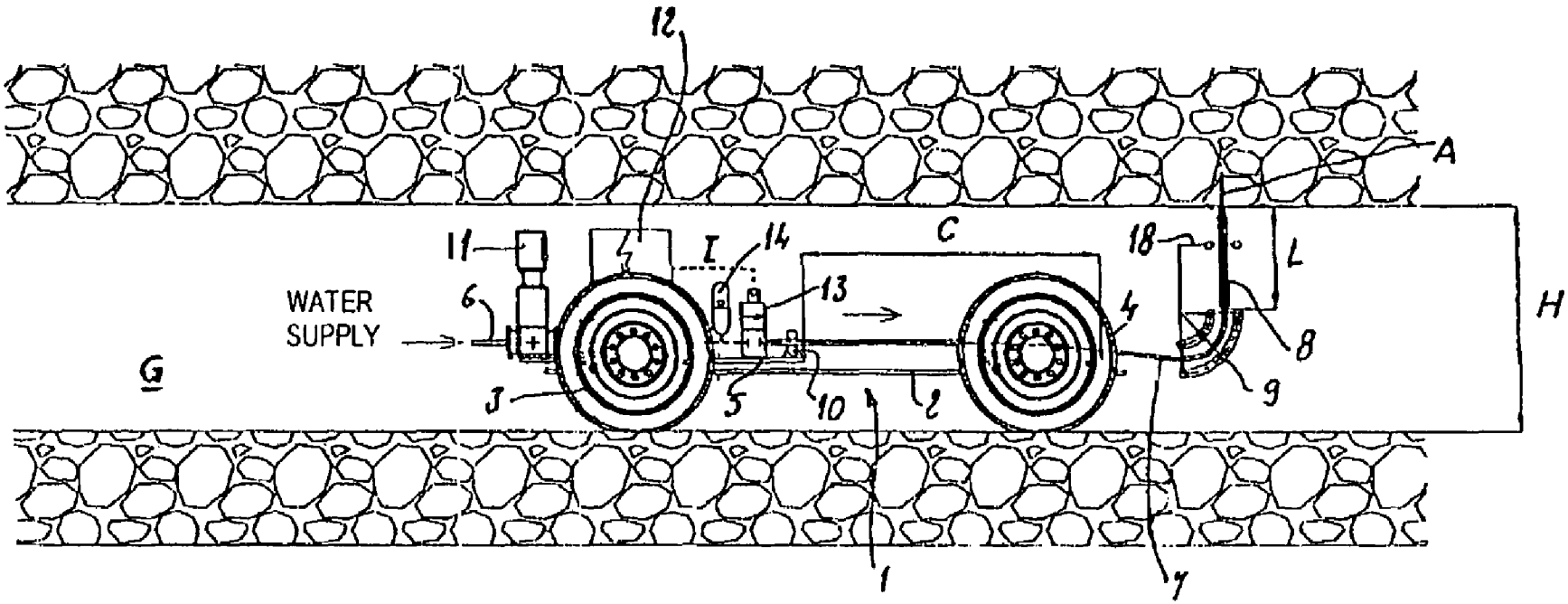
FIG. 1 is a side view, in a mine gallery, of a drilling device according to the present invention at the start of the drilling of a hole.
Figure 2:
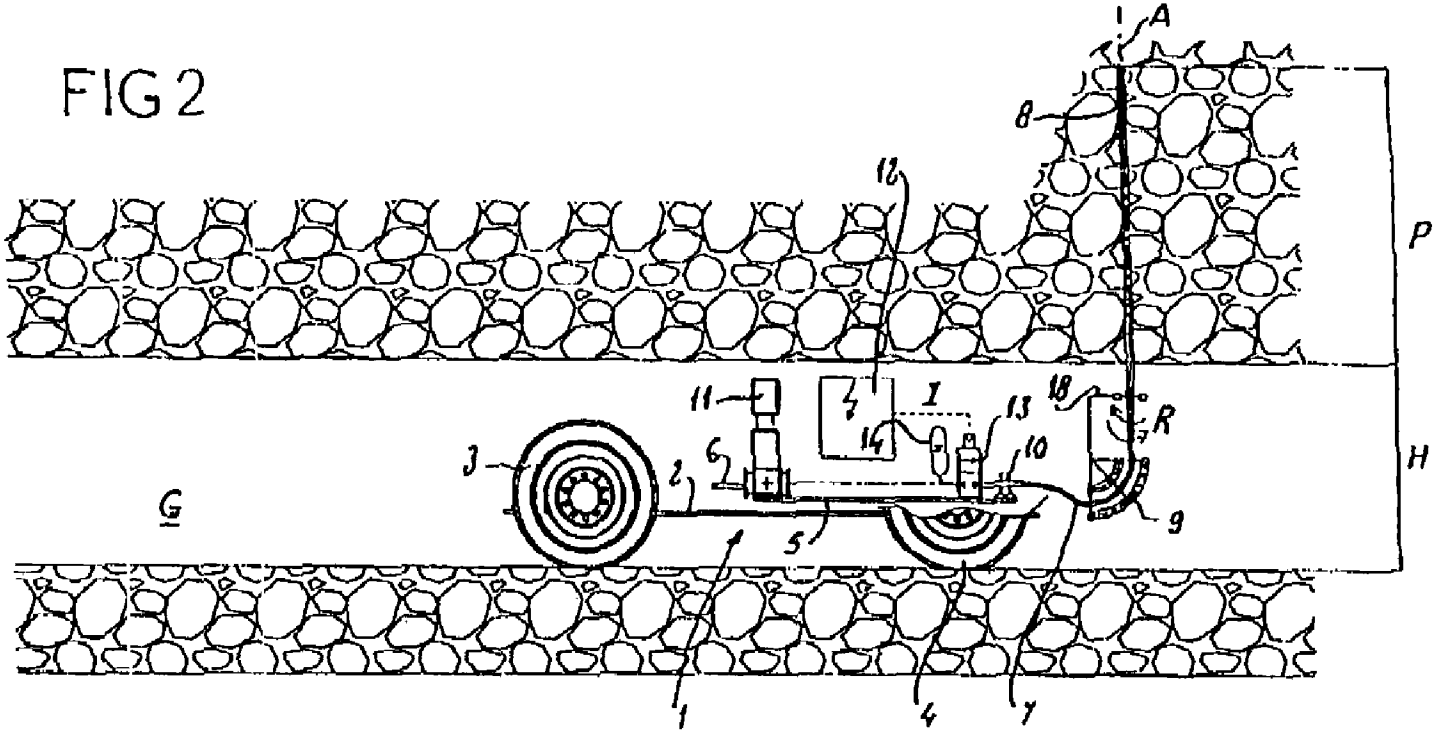
FIG. 2 is a view similar to FIG. 1, at the end of drilling of the hole.

As shown in FIGS. 1 and 2, a carrying vehicle 1 moves the drilling device according to the invention in a mine gallery G having a low height H in the range from 1.0 to 1.5 meters, for example 1.1 meters. The carrying vehicle 1 has a rigid one-piece chassis 2, of generally parallelepipedal shape, positioned at a relatively small height above the ground on which the carrying vehicle 1 moves by means of four driving wheels, namely two rear wheels 3 and two front wheels 4. On the upper side of the chassis 2 there is mounted a movable platform 5 which is movable by translation in the longitudinal direction of the chassis 2 along a path C, by motorized operating means (not shown), for example a motor carried by the chassis 2 and an endless chain transmission.

A drill body 8, of generally cylindrical shape with a principal axis A, and having a length L, is placed when in use at the position of the hole to be drilled, and connected by a flexible pipe 7 to a water pump 11 at a high pressure of approximately 150 bars, mounted on the movable platform 5 and connected, at the rear of the vehicle 1, to a water supply 6. The water pump 11 can include an incorporated pressure limiter.

Figure 3:
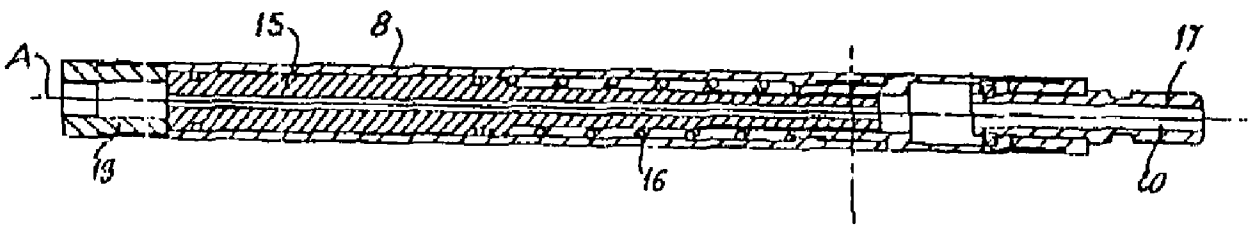
FIG. 3 is a longitudinal sectional view of the drill body.

A striking piston 15 is mounted movably, and is resiliently returned by a return spring 16, in the drill body 8 (see FIG. 3), and is subjected to a pulsed high water pressure so as to be moved with a percussive movement against a bit-carrying anvil 17, by the means detailed below. The drill body 8 has a connector 19 at its rear for connection to the flexible pipe 7.

A solenoid valve 13 is interposed, on the movable platform 5, between the water pump 11 and the point of departure of the flexible pipe 7. The solenoid valve 13 is coupled to an electrical pulse generator 12 whose frequency can be in the range from 30 to 70 Hz. A hydraulic accumulator 14, also mounted on the movable platform 5, enables the pressure peaks related to the water pump 11 to be limited.

Means for rotating the flexible pipe 7, for example rollers 10, are provided on the movable platform 5. A guide slide 9, in the form of an elbow, is positioned at the front of the carrying vehicle 1 in order to divert the flexible pipe 7 and guide it in translation in the vertical direction.

The drilling is carried out by the different movements of percussion, thrust and rotation described below.

The solenoid valve 13 receives successive electrical pulses I from the pulse generator 12, causing it to open and close alternately and thus creating shock waves in the water column contained in the flexible pipe 7. The flexible pipe 7 transmits these shock waves to the striking piston 15 mounted in the drill body 8.

Being subjected to this pulsed high pressure and resiliently returned by its return spring 16, the striking piston 15 is given a percussive movement against the bit-carrying anvil 17 of the drill body 8.

The rollers 10 rotate the flexible pipe 7 in such a way that it simultaneously transmits an alternating rotary movement R about the principal axis A of the drill body 8 to the bit-carrying anvil 17. This rotary reciprocating movement is advantageous by comparison with a unidirectional rotary movement, because it enables the rock to be broken without the need to rotate the bulky assembly of elements mounted on the carrying vehicle 1.

At the same time, the movable platform 5 is moved by longitudinal translation on the chassis 2, as the drilling proceeds, from an initial position corresponding to the start of drilling (see FIG. 1) to an end of travel position in which the desired depth P of the drilled hole T is reached (see FIG. 2). The depth P of the drilled hole T is equivalent to the travel of the flexible pipe 7, which is advantageously limited only by the total length of the flexible pipe 7, increased by the length L of the drill body 8, and by the translational travel C of the movable platform 5.

During its travel, the platform 5 progressively advances the flexible pipe 7 in the diverting and vertically guiding slide 9. The flexible pipe 7 transmits this thrust movement to the drill body 8, enabling the latter to drill more deeply into the rock until the maximum hole depth P, which in this case for example is 1.50 meters, is reached. Clearly, lesser depths can be reached by reducing the travel C of the platform 5. It should be noted that, at the start of the hole to be drilled T, a support and guide member 18 for the drill body 8 is advantageously made to intervene (see FIG. 1) so as to position this drill body 8 suitably and ensure that it is initially guided in a straight line, before it is itself guided in the portion of hole already drilled.

Because of a central water discharge orifice 20 formed in the bit-carrying anvil 17, the debris of rocks broken during drilling are removed with the water, if necessary through openings such as grooves (not shown) formed in the drill body 8.

Clearly, the invention is not limited solely to the embodiment of this drilling device described above by way of example; on the contrary, it includes all variant embodiments and applications using the same principle. Thus, for example, there would be no departure from the scope of the invention if details of construction of the drill body were modified, or if use were made of any equivalent means, for example by replacing the advance system using a movable platform mounted on the carrying vehicle with an equivalent system for unwinding the flexible pipe, with an unwinder mounted on the carrying vehicle and provided with a rotary joint connecting the point of departure of the flexible pipe to the water pump.

The invention claimed is:

1. A rotary percussive drilling device, adapted for use in low-height mine galleries, having a drill body of generally cylindrical shape, connected by a pipe to a remotely located high-pressure water pump, a striking piston being mounted to be movable by translation in the drill body and being subjected to a pulsed high water pressure so as to be moved with a percussive movement against a bit-carrying anvil, the pipe simultaneously transmitting a rotary movement to the drill body about its principal axis, wherein the drill body is connected by a flexible pipe to a water pump placed on a low-height carrying vehicle, and a solenoid valve is interposed on the carrying vehicle between the water pump and the point of departure of the flexible pipe, the solenoid valve receiving, in operation, successive electrical pulses to cause its opening and closing, which create shock waves in the water column contained in the flexible pipe, and which transmits these shock waves to the striking piston, which is resiliently returned, of the drill body.

2. The drilling device as claimed in claim 1, wherein a hydraulic accumulator is associated, on the carrying vehicle, with the water pump.

3. The drilling device as claimed in claim 1, wherein means for advancing and guiding in translation the flexible pipe are provided on the carrying vehicle to transmit a thrust movement to the drill body, a depth of a drilled hole being substantially equivalent to the travel of the flexible pipe.

4. The drilling device as claimed in claim 3, wherein the means for advancing the flexible pipe comprise a platform mounted to be movable by horizontal translation on a chassis of the carrying vehicle, in a longitudinal direction of this chassis, the water pump and an electrical pulse generator coupled to the solenoid valve being mounted on this platform, the platform being movable by translation in the longitudinal direction of the chassis by motorized operating means.

5. The drilling device as claimed in claim 2, wherein the means for guiding the flexible pipe in translation include a slide or channel for diverting and guiding in a vertical direction, positioned at a front of the carrying vehicle.

6. The drilling device as claimed in claim 1, wherein means for rotating the flexible pipe are provided on the carrying vehicle to transmit to the drill body an alternating rotary movement about its principal axis.

7. The drilling device as claimed in claim 1, wherein the drilling device comprises means for supporting and guiding the drill body when starting a hole to be drilled.

* * * * *